United States Patent [19]

Aalpoel

[11] 3,949,652

[45] Apr. 13, 1976

[54] DEVICE FOR MANUFACTURING A FLAP BOX

[75] Inventor: Marten Geert Aalpoel, Nuenen, Netherlands

[73] Assignee: Arenco-P.M.B. B.V., Best, Netherlands

[22] Filed: May 1, 1974

[21] Appl. No.: 466,014

[30] Foreign Application Priority Data

May 10, 1973 Netherlands ..... 7306565

[52] U.S. Cl. ..... 93/36 MM; 93/52; 93/84 TW

[51] Int. Cl.[2] ..... B31B 1/36

[58] Field of Search 93/36 MM, 44, 49, 52, 84 TW, 93/36.8; 53/374

[56] References Cited

UNITED STATES PATENTS

| | | | |
|---|---|---|---|
| 1,775,753 | 9/1930 | Evans et al. | 53/374 X |
| 1,857,680 | 5/1932 | Van Der Pyle et al. | 93/49 R |
| 2,116,362 | 5/1938 | Ness | 93/44 X |
| 3,435,738 | 4/1969 | Berney | 93/36 MM |
| 3,584,548 | 6/1971 | Brown | 93/49 R |

FOREIGN PATENTS OR APPLICATIONS

| | | | |
|---|---|---|---|
| 598,010 | 8/1931 | Germany | 53/374 |

*Primary Examiner*—Willie G. Abercrombie
*Assistant Examiner*—Leon Gilden
*Attorney, Agent, or Firm*—John P. Snyder

[57] ABSTRACT

The invention relates to a device for manufacturing a flap box, in which peripheral strips at the open ends of a rectangle-section box formed previously from a plano are provided with glue and subsequently bent over, after which the sidewalls of the box are cut in the longitudinal sense; the device according to the invention comprises holders having each a box, at least one gluing member adapted to move towards and away from each of said holders for applying glue to the faces of one pair of opposite peripheral strips orientated to the same side and stops adapted to move relatively to said holders for folding over in sequence one glued peripheral strip located nearest said side, the other pair of opposite peripheral strips and the other glued peripheral strip.

13 Claims, 8 Drawing Figures

FIG. 4
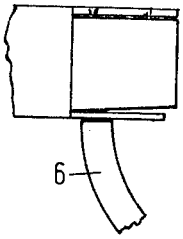
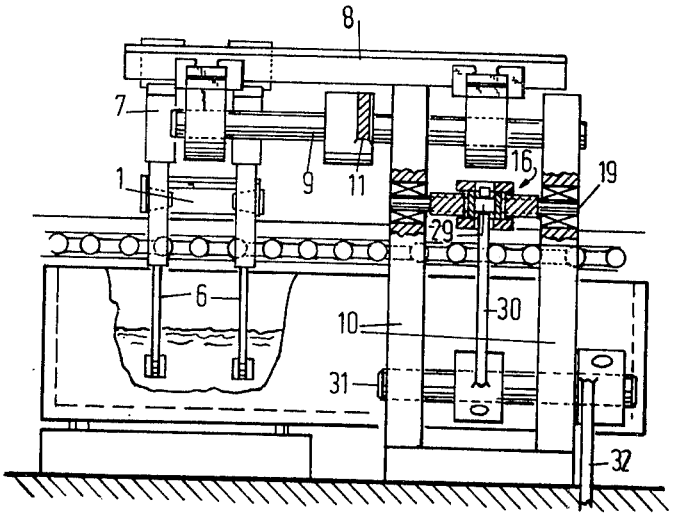
FIG. 3
FIG. 5a
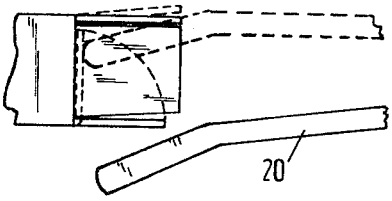
FIG. 5b
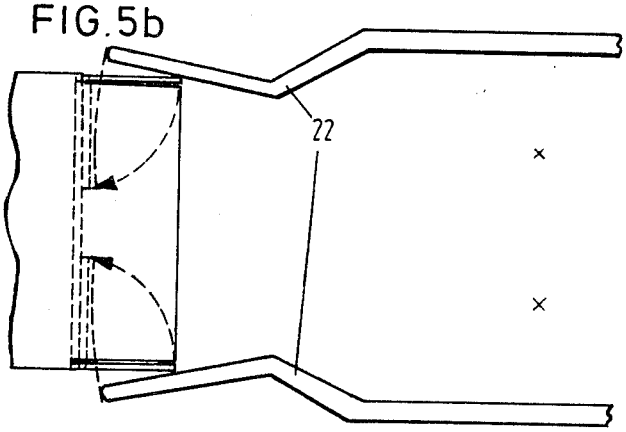
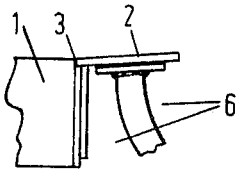
FIG. 6
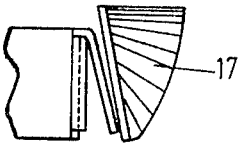
FIG. 7

DEVICE FOR MANUFACTURING A FLAP BOX

The invention relates to a device for manufacturing a flap box, in which the peripheral strips at the open ends of a rectangle-section box formed previously from a plano are provided with glue and subsequently bent over, after which the sidewalls of the box are cut in the longitudinal sense.

The invention has for its object to provide a device which permits of manufacturing, in particular, flap boxes having a neck formed from a single plano. Hitherto it has been common practice to make such flap boxes with necks from two separate plano's. However, the use of a single plano requires a predetermined order of succession of operations. As in the prior art the device according to the invention receives boxes formed from one plano with two open ends. The device differs from the known devices in that it comprises holders having each a box, at least one gluing member adapted to move towards and away from each of said holders for applying glue to the faces of one pair of opposite peripheral strips orientated to the same side and stops adapted to move relatively to said holders for folding over in sequence one glued peripheral strip located nearest said side, the other pair of opposite peripheral strips and the other glued peripheral strip.

The invention will now be described more fully with reference to the following description of a preferred embodiment shown in the drawing. In the drawing:

FIG. 3 is a sectional view taken on the line III—III in FIG. 1,

FIGS. 4 to 7 show the order of operations of applying glue to the peripheral strips and of folding the same.

Figure 1:
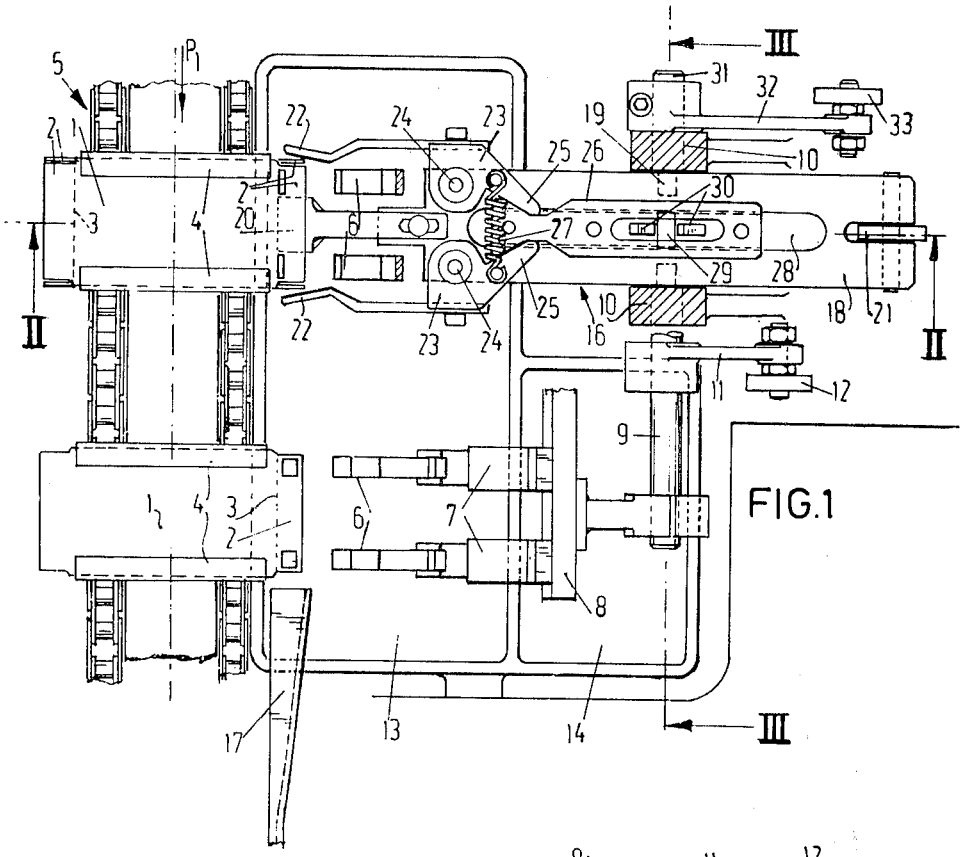
FIG. 1 is a plan view of an embodiment of the invention.
Figure 2:
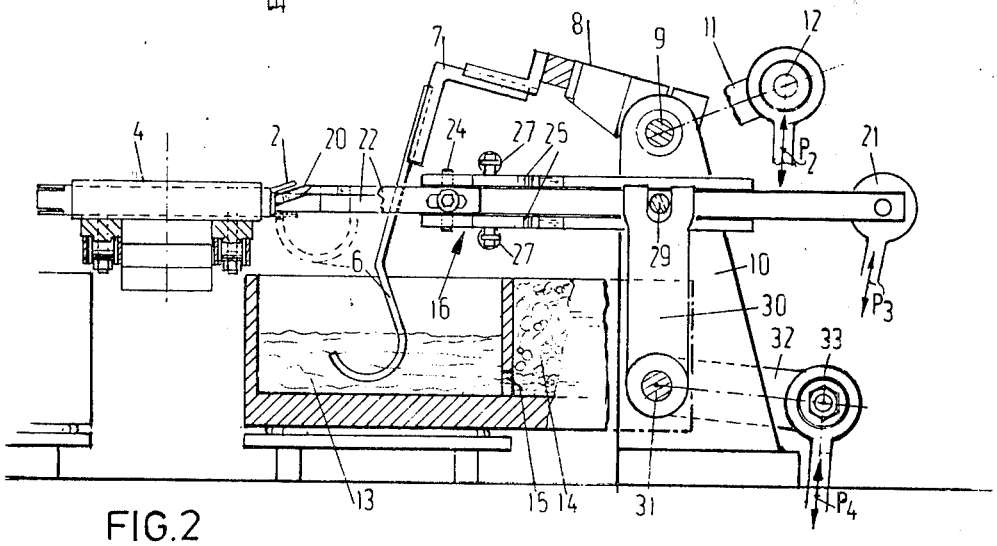
FIG. 2 is a sectional view taken on the line II—II in FIG. 1.

FIGS. 1, 2 and 3 show an open-ended box 1 formed from a plano. At the open ends the rectangle-section box is provided with peripheral strips 2, which have to be folded over along groove lines 3 between the peripheral strips and the sidewalls of the box in the manner illustrated in FIGS. 4 to 7 after these peripheral strips have been suitably provided with glue.

Each box 1 is received in a holder 4. The holders are fastened at given intervals to a conveyor 5 formed by two endless chains. This conveyor is propelled stepwise in the direction of the arrow P (see FIG. 1), each step covering the distance between the holders.

At the side of the conveyor 5 with the holders 4 is arranged a gluing and folding mechanism comprising gluing members adapted to move with respect to the holders 4 and stops for folding the peripheral strips.

The gluing mechanism comprises two pairs of hook-like gluing members 6 (see FIGS. 1 and 2), each member being fastened to a pivotable support 7, only the two lowermost supports being shown in FIG. 1. These supports 7 are slidably fastened to a common supporting beam 8 extending parallel to the conveyor 5. The supporting beam is rigidly secured to a common hinge shaft 9, which is rotatably held in supports 10. The hinge shaft 9 has furthermore secured to it a lever 11, to the free end of which is secured a connecting rod 12 driven by any suitable driving member. By turning the lever 11 about the shaft 9, all gluing members 6 will move up and down respectively. In the lowermost position of the gluing members 6 their hook-like ends are located in a glue solution 13. This glue solution may, if necessary, be heated in order to keep the liquid glue at the desired degree of viscosity. The glue solution bath may have a separate supply portion 14, to which fresh glue not yet heated at the correct temperature is supplied and is gradually heated to the desired temperature in said portion communicating through an opening 15 with the portion 13 (see FIG. 2).

The folding mechanism comprises a movable part generally designated by 16 and a stop 17 arranged behind the gluing members 6, viewed in the direction of conveyance (see FIG. 1).

The movable folding mechanism 16 comprises a blade-shaped support 18 adapted to oscillate in the supports 10. The oscillatory movement is performed around a shaft 19 located at a given distance vertically beneath the pivotal shaft 9 of the gluing members (see FIG. 3). At the end facing the conveyor 5 the blade-shaped support 18 is prolonged by a tag-shaped stop 20. This tag 20 is adjustably fastened to the support 18 and is kinked at its operative end (see FIG. 2). The oscillatory movement of the blade-shaped support 18 is obtained by a connecting rod 21 fastened to its end remote from the folding tag 20 and actuated by a driving gear (not shown) in the direction of the arrow $P_3$.

On either side of the folding tag 20 folding tags 22 are adapted to move towards and away from each other. These folding tags 22 are arranged each on a support 23, which is rotatably mounted on the end of the blade-shaped support 18 facing the conveyor 5 by means of a pin 24. Each support 23 is provided with a nose 25, which co-operates with a particularly designed control-surface of a slide 26. The contact of the nose 25 with the control-surface of the slide is maintained by a tensile spring 27 arranged between the noses. The slide 26 is displaceable in a slot 28 of the blade-shaped support 18. The slide 26 itself also has a slot, at the centre of which a pin 29 is mounted, around which a fork-like lever 30 is gripping. The lever 30 is fastened to a shaft 31 rotatably arranged in the supports 10 and having secured to its end a lever 32, which is coupled by its free end with a connecting rod 33. The driving rod 33 is adapted to move up and down in the direction of the arrow $P_4$ by means of a driving member (not shown). It should be noted that in the rest position of the connecting rod 33 and the fork-like lever 30 respectively the centre line of the pin 29 accurately coincides with the centre line of the pivotal shaft 19 so that, when the blade-shaped support 18 is oscillating, the slide 26 is not exposed to reactions of the fork 30. Nevertheless, in any position of the blade-shaped support 18 the fork 30 can be turned so that the pin 29 moves to the right viewed in FIG. 1 and thus takes along the slide 26. The control-surface of the slide 26 causes the noses 25 to move away from each other and the folding tags 22 to approach one another. After returning the lever 30, the spring 27 draws the folding tags 22 away from each other. Finally it should be noted that the various stops and gluing members are displaceably arranged on their respective supports for matching different sizes of boxes.

The movements of the folding tags are lagging behind the movements of the gluing members, which will be explained more fully with reference to FIGS. 4 to 7.

After a holder 4 with a box 1 has arrived in front of the topmost pair of gluing members (see FIG. 1), this pair of gluing members will be moved upwards out of the glue solution under the action of the connecting rod 12. The gluing members 6 of said first pair then arrive at the position shown in broken lines in FIG. 2 and the active end face of the hook comes into contact with the lower face of the lower peripheral strip of the box. Since in this embodiment the hooks have a narrow, rectangular top face, a narrow line of glue is each time left on this lower peripheral strip. After the hook-like gluing members 6 have returned, the blade-shaped support will perform a balancing movement under the control of the connecting rod 21 so that the folding tag 20 will fold upwards this lower peripheral strip by its kinked end (see FIG. 5a). The upward movement of the folding tag 20 continues until also the upper peripheral strip of the box is lifted by the kinked end of the folding tag 20. Thus the upper peripheral strip will not hinder folding of the two lateral strips. Folding of these peripheral side strips is performed by the relative approach of the folding tags 22 under the control of the connecting rod 33, whilst the folding tag 20 is in its topmost position, the side strips being thus folded inwardly (see FIG. 5b). These side strips adhere to the glue already provided. Subsequently the connecting rods 33 and 21 return one after the other to their initial positions.

The conveyor 5 moves on by one step and passes the box thus folded to the lowermost position shown in FIG. 1. Under the control of the connecting rod 12 the lower pair of gluing members 6 moves upwards so that the position shown in FIG. 6 is attained. Each of the gluing hooks of the lower pair has a comparatively broad, rectangular top face so that a broad line of glue is left on the lower side of the upper peripheral strip. After a further movement of the conveyor 5 this peripheral strip is folded over along the stationary stop 17 (see FIG. 7).

The invention is explained with reference to only one folding and gluing mechanism arranged on one side of the conveyor 5. As a matter of fact, the same mechanisms may also be arranged on the other side of the conveyor 5 for closing the other open end of the box.

The invention is not restricted to the embodiment described above. It may be imagined to replace the hook-like gluing members by spraying nozzles, which are suitably arranged along the conveyor 5 in a movable manner, whilst more or fewer stops of the folding mechanism may be stationary, whilst the conveyor carries the boxes in an appropriate manner along said stops.

What is claimed is:

1. Apparatus for applying glue and folding box ends comprising, in combination:

conveyor means for conveying box forms which are to be glued and folded at one end, each box form being of rectangular tubular form having first and second long side flaps and opposite side flaps at said one end;

glue-applying means for applying glue to each first flap and to each second flap; and folding means for holding said first flap over the box end, folding said side flaps onto said first flap after it has been folded and said second flap onto said side flaps after they have been folded;

said glue-applying means including a pair of members movable from a first position out of contact with said first flap and a second position in which said members are effective to apply glue to said first flap.

2. Apparatus as defined in claim 1 wherein said conveyor means moves said box forms in step-by-step fashion and wherein said glue-applying means comprises a pair of glue-applying stations whereat a box form is sequentially positioned, said pair of members being located at that first glue-applying station at which a box form is first positioned.

3. Apparatus as defined in claim 2 wherein said folding means comprises a side flap folding assembly positioned at said first glue-applying station.

4. Apparatus as defined in claim 3 wherein said folding means includes a second flap folding device adjacent the second glue-applying station.

5. Apparatus as defined in claim 4 wherein said second flap folding device comprises a fixed device for folding the second flap when the box form is moved beyond said second glue-applying station.

6. Apparatus as defined in claim 1 including a glue supply in which said members reside while in said first position, and means for oscillating said members between said first and second positions whereby said members wipe across said first flap to apply glue thereto.

7. Apparatus as defined in claim 2 including a glue supply in which said members reside while in said first position, and means for oscillating said members between said first and second positions whereby said members wipe across said first flap to apply glue thereto, the second glue-applying station comprising a second pair of members movable between a first position residing in said glue supply and a second position touching the unfolded second flap to apply glue thereto.

8. Apparatus as defined in claim 1 including a first flap folder swingable to fold said first flap and to swing said second flap aside slightly, said folding means including a pair of side flap folding devices actuated while said second flap is swung aside.

9. Apparatus for applying glue and folding box ends comprising, in combination:

conveyor means for traveling a series of box forms along a path in step-by-step fashion, said conveyor means including a plurality of holders which retain the box forms horizontally in rectangular, tubular form to present top and bottom flaps and opposite side flaps at one end of each box form, said holders being spaced apart by the distance of the step-by-step movement of the conveyor means;

a first glue-applying station adjacent said conveyor means and including a pair of upwardly swingable members which wipe across said bottom flap to apply two stripes of glue thereto, a bottom flap folder upwardly swingable between said glue-applying members to fold said bottom flap across the box form end, and a pair of end flap folders between which said upwardly swingable members swing and including means for moving said end flap folders toward each other to fold said end flaps onto said bottom flap to engage the respective glue stripes;

a second glue-applying station disposed beyond said first station and including a second pair of upwardly swingable members which engage the underside of said top flap to apply rectangular glue spots thereto; and a fixed member disposed beyond said second glue-applying station to fold said top flap down against said folded side flaps as said conveyor means advances a box form beyond said second glue-applying station.

10. Apparatus as defined in claim 9 including a horizontal support for said bottom flap folder and said end flap folders and pin means pivotally connecting said end flap folders to said support, said support being pivotally mounted about a first horizontal axis parallel to the path of the conveyor means and including means for swinging said support about the first axis to cause said bottom flap folder to fold the bottom flap across the box form end and swing said top flap slightly aside to clear said end flaps.

11. Apparatus as defined in claim 10 including a slide on said support and means for reciprocating said slide back and forth perpendicular to the path of the conveyor means on said support, said end flap folders being engaged by said slide to swing toward each other as the slide is moved away from said conveyor means.

12. Apparatus as defined in claim 11 wherein said slide includes a pin aligned along said first axis and said means for reciprocating comprises a lever engaging said pin.

13. Apparatus as defined in claim 12 including a support shaft disposed above and parallel to said first axis, said glue-applying members being pivotally carried by said support shaft for oscillation about the axis thereof.

* * * * *